US009597645B2

(12) United States Patent
Takenaka et al.

(10) Patent No.: US 9,597,645 B2
(45) Date of Patent: Mar. 21, 2017

(54) STIRRING METHOD

(71) Applicant: PANASONIC INTELLECTUAL PROPERTY MANAGEMENT CO., LTD., Osaka (JP)

(72) Inventors: Yuki Takenaka, Osaka (JP); Akinobu Okuda, Nara (JP); Tsuyoshi Tojo, Osaka (JP); Tohru Nakamura, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 688 days.

(21) Appl. No.: 13/933,331

(22) Filed: Jul. 2, 2013

(65) Prior Publication Data

US 2014/0016431 A1 Jan. 16, 2014

(30) Foreign Application Priority Data

Jul. 2, 2012 (JP) ..... 2012-148240
Feb. 8, 2013 (JP) ..... 2013-022893
Jun. 5, 2013 (JP) ..... 2013-118926

(51) Int. Cl.

*B01F 9/00* (2006.01)
*B01F 9/04* (2006.01)
*B01F 9/10* (2006.01)
*B01F 3/08* (2006.01)
(Continued)

(52) U.S. Cl.

CPC ..... *B01F 11/0062* (2013.01); *B01F 3/0819* (2013.01); *B01F 3/12* (2013.01); *B01F 9/0014* (2013.01); *B01F 9/04* (2013.01); *B01F 9/103* (2013.01); *B01F 11/0022* (2013.01)

(58) Field of Classification Search

CPC B01F 11/0022; B01F 11/0062; B01F 3/0819; B01F 3/12; B01F 9/0014; B01F 9/04
USPC ..... 366/118, 130, 111, 114, 116, 197, 208, 366/209, 212, 240
See application file for complete search history.

(56) References Cited

U.S. PATENT DOCUMENTS 1,448,446 A * 3/1923 Hulbert ..... A23G 1/24 108/20
3,091,435 A * 5/1963 Pease ..... B01F 11/0062 118/418

(Continued)

FOREIGN PATENT DOCUMENTS

CN 102119018 7/2011
JP 62-286527 12/1987

OTHER PUBLICATIONS

Chinese Office Action (OA) and Search Report (SR) issued Feb. 16, 2015 in counterpart Chinese Patent Application No. 201310274594.0, together with English translations thereof.

*Primary Examiner* — Tony G Soohoo
(74) *Attorney, Agent, or Firm* — Wenderoth, Lind & Ponack, L.L.P.

(57) ABSTRACT

A drug container is arranged in a horizontal state where a central axis extends along a horizontal direction, and the drug container is rotated about the central axis. In such a way, a drug solution in the drug container is moved along an inner surface of the drug container, and the drug container is reciprocally vibrated along the central axis in a state where the drug container is rotated, to stir the drug solution.

7 Claims, 15 Drawing Sheets

(51) Int. Cl.
*B01F 3/12* (2006.01)
*B01F 11/00* (2006.01)

(56) References Cited

U.S. PATENT DOCUMENTS 3,682,080 A * 8/1972 Merz ..... G03D 13/046
366/208
3,703,860 A * 11/1972 Wilkinson ..... G03D 13/046
396/573
3,706,443 A * 12/1972 Oberhauser ..... B01F 9/0001
366/216
3,977,876 A * 8/1976 Ratowsky ..... B01F 9/0016
366/166.1
4,004,784 A * 1/1977 Distler ..... A61F 13/041
118/418
4,281,936 A * 8/1981 Schotter ..... B01F 9/0001
366/209
4,302,092 A * 11/1981 Ashton ..... G03D 13/046
134/121
4,373,029 A * 2/1983 Nees ..... B01F 9/002
366/214
5,121,991 A * 6/1992 Wakatake ..... B01F 11/0037
366/208
5,215,376 A * 6/1993 Schulte ..... B01F 11/0037
141/265
5,238,304 A * 8/1993 Zimmermann ..... B01F 9/0001
366/108
5,458,416 A 10/1995 Edwards et al.
8,596,309 B2 12/2013 Mizuno et al.

* cited by examiner

Fig.13

| | STATIONARILY LEAVING TIME | STIRRING TIME | TOTAL TIME | STIRRING CIRCUMSTANCE | |
|---|---|---|---|---|---|
| | | | | FOAMING | UNDISSOLVED RESIDUE |
| MANUAL PREPARATION | 300 SECONDS | 180 SECONDS (MANUAL) | 480 SECONDS | NONE | NONE |
| CONDITION 1 | 300 SECONDS | 60 SECONDS (AUTOMATIC) | 360 SECONDS | NONE | NONE |
| CONDITION 2 | 180 SECONDS | 90 SECONDS (AUTOMATIC) | 270 SECONDS | NONE | NONE |

STIRRING METHOD

FIELD OF THE INVENTION

The present invention relates to a stirring method and a stirring apparatus, which stir and mix a drug.

Background of Related Art

At the time of prescribing a drug for an inpatient or the like in a hospital or the like, there is a case of mixing drugs with different specific gravities with each other, followed by prescription thereof, or a case of mixing a powder drug with a liquid drug, followed by prescription thereof. Such mixing of the drugs is performed, for example, by stirring resulting from manually stirring a drug bottle. However, the stirring work as described above is a large load. Moreover, the stirring work as described above has problems in that the mixing of the drugs becomes nonuniform, and that foaming occurs therein.

Accordingly, in order to reduce the load of the stirring work as described above, there is proposed a mixing device that uniformly mixes powder and liquid while defoaming a mixture thereof (for example, refer to JP 62-286527 A).

FIG. 14 is a perspective view showing an entirety of a conventional mixing device. In the mixing device shown in FIG. 14, vibrators 2 are arranged on four corners of a lower surface of an upper base 1. The vibrators 2 vibrate, thereby the upper base 1 vibrates in the vertical direction along an arrow 1*a*. Moreover, by rotation of a motor 9 disposed in an inside of a lower base 4, a hoop 12 disposed on an upper surface of the upper base 1 rotates at a predetermined speed.

At the time of mixing powder and liquid with each other, for example, a container 17 that contains the powder and the liquid is set on the hoop 12, and thereafter, a paddle 19 is set in the container 17. When the hoop 12 rotates, the container 17 on the hoop 12 rotates with respect to the paddle 19 that is staying still, and the powder and the liquid in an inside of the container 17 are mixed with each other. At this time, when the vibrators 2 are vibrated, the powder and the liquid in the container 17 vibrate at a high speed as well as perform rotational motion. By such operation as described above, the powder and the liquid are stirred and mixed with each other by the paddle 19. Furthermore, the powder and the liquid are stirred and mixed with each other in a state where an internal pressure of the container 17 is reduced to a pressure lower than the atmospheric pressure, and accordingly, defoaming is also performed effectively.

Hence, if the mixing device shown in FIG. 14 is used, the powder and the liquid can be mixed uniformly with each other without doing handwork therefor.

However, in the above-described conventional technology, since the powder and the liquid vibrate at a high speed as well as perform rotational motion, drugs to be stirred foam in some cases. Therefore, in the conventional technology, it is necessary to remove bubbles generated by the foaming.

SUMMARY OF THE INVENTION

It is an object of the present invention to provide a stirring method and a stirring apparatus, which are capable of stirring and mixing the drugs without requiring a mechanism for removing bubbles.

In accomplishing the object, according to one aspect of the present invention, there is provided a stirring method comprising:

rotating a drug container about a central axis thereof to move a drug solution in the drug container along an inner side surface of the drug container; and thereafter reciprocally vibrating the drug container along the central axis in a state where the drug container is rotated, to stir the drug solution.

In accomplishing the object, according to one aspect of the present invention, there is provided a stirring apparatus comprising:

a container support unit that supports a drug container;

a rotation mechanism unit that rotates the container support unit about a central axis of the drug container;

a vibration mechanism unit that reciprocally vibrates the container support unit along the central axis; and a control unit that controls the rotation mechanism unit and the vibration mechanism unit, wherein the control unit rotates the drug container to move a drug solution in the drug container along an inner side surface of the drug container, and reciprocally vibrates the drug container along the central axis in a state where the drug container is rotated, to stir the drug solution.

In accomplishing the object, according to an other aspect of the present invention, there is provided a stirring method comprising:

rotating a drug container about a central axis thereof at a first rotation speed to allow a solution to penetrate a lump of a second drug in the drug container;

rotating the drug container at a second rotation speed faster than the first rotation speed to move the solution and the second drug in the drug container along an inner surface of the drug container; and reciprocally vibrating the drug container along the central axis in a state where the drug container is rotated, to stir the solution and the drug.

In accordance with the aspects of the present invention, there can be provided the stirring method and the stirring apparatus, which are capable of stirring and mixing the drugs without requiring the mechanism for removing the bubbles.

BRIEF DESCRIPTION OF THE DRAWINGS

These and other aspects and features of the present invention will become clear from the following description taken in conjunction with the embodiments thereof with reference to the accompanying drawings, in which:

FIG. 13 is a table-format explanatory view for explaining a comparison example between the stirring method in the third embodiment of the present invention and a conventional manipulation method.

DESCRIPTION OF THE EMBODIMENTS

Figure 1:
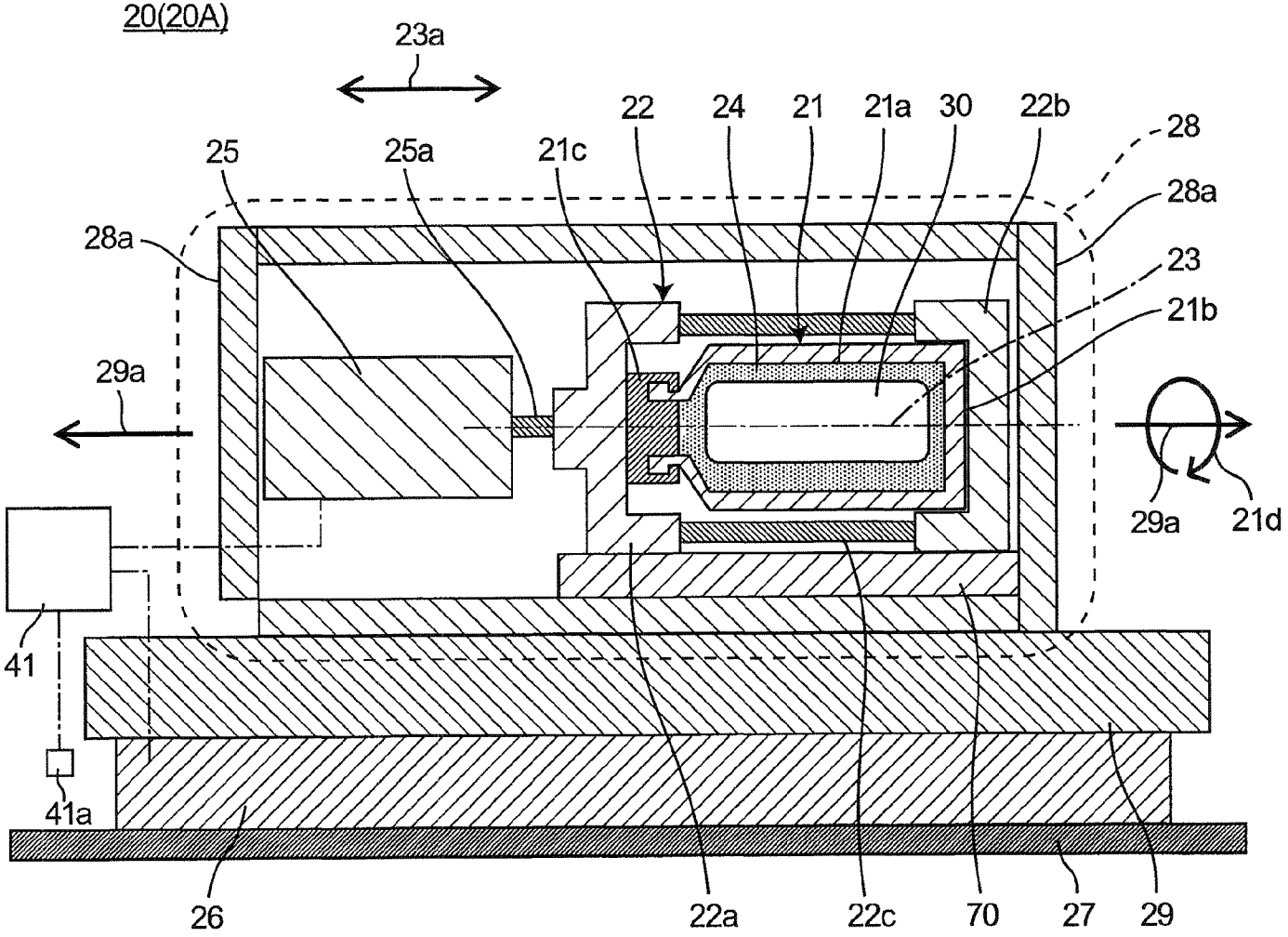
FIG. 1 is a cross-sectional view showing a schematic configuration of a stirring apparatus according to a first embodiment and third embodiment of the present invention.

A description is made below of embodiments of the present invention while referring to the drawings. Note that the same reference numerals are denoted to the same components, and a description thereof is sometimes omitted. The drawings mainly and schematically show the respective components for the purpose of facilitating the understanding.

(First Embodiment)

FIG. 1 is a cross-sectional view showing a schematic configuration of a stirring apparatus 20 according to a first embodiment of the present invention. FIG. 1 illustrates a drug solution 24 in a third step to be described later.

A stirring method using the stirring apparatus 20 of the first embodiment is a method including a first step S100, a second step S200, and a third step S300.

Here, the first step S100 is an example of a container arranging step of arranging a drug container 21 in a container support unit 22. Specifically, the first step S100 is, as shown in FIG. 1, a step of preparing the drug container 21 with a columnar shape, and thereafter, arranging the drug container 21 in the container support unit 22 so that a central axis 23 thereof can extend along a horizontal direction 23*a*. The first step S100 may be carried out in advance.

The second step S200 is an example of a rotating step of rotating the container support unit 22 and the drug container 21 about the central axis 23 thereof. Specifically, the second step S200 is a step of rotating the container support unit 22 and the drug container 21 so that the drug solution 24 in the drug container 21 can be separated from a gas space 30 in the drug container 21 and go along an inner side surface 21*a* of the drug container 21.

The third step S300 is an example of a rotationally vibrating step of reciprocally vibrating the drug container 21 along the central axis 23 in a state where the drug container 21 is rotated. Specifically, the third step S300 is a step of performing a vibrational motion together with a rotational motion for the container support unit 22 and the drug container 21.

The drug solution 24 in the first embodiment is an example of a liquid drug and is an example of a solution layer. For example, the drug solution 24 is a solution obtained by mixing two types of liquid drugs with each other, or is a solution such as physiological salt solution into which a powder drug is mixed. Note that the drug solution in the present invention is an example of the liquid drugs, and includes not only a liquid drug (medicine) but also a liquid chemical substance such as a reagent for use in a chemical experiment. Therefore, the drug solution in the present invention includes, for example, a solution for use in substance detection and substance synthesis by a chemical method, or for use in measurement or the like of physical properties of a substance.

The first embodiment of the present invention is characterized in that, in an event of performing stirring work, the third step S300 is performed after the second step S200 is performed, thereby it is possible to reliably stir and mix, for example, a powder drug (not shown) such as an anticancer drug and the drug solution 24 in the drug container 21 with each other without causing foaming therein. A description is made of reasons why the powder drug and the drug solution 24 can be reliably stirred and mixed with each other without causing the foaming therein. In the first embodiment of the present invention, first, in the second step S200, the drug solution 24 is moved to the inner side surface 21a of the drug container 21 by centrifugal force by only a rotational motion. Thereafter, in the third step S300, in a state where the drug solution 24 is going along the inner side surface 21*a* of the drug container 21 by the centrifugal force of the rotational motion, the vibrational motion is applied together with the rotational motion to the container support unit 22 and the drug container 21, thereby the foaming of the drug solution 24, which may be caused by such vibrations, can be prevented, and the drug solution 24 can be reliably stirred and mixed. As described above, in the first embodiment, in the drug container 21, the gas space 30 is collected to a center portion thereof, and the drug solution 24 is pressed against the vicinity of the inner side surface 21*a* by the centrifugal force, and the drug solution 24 is stirred while being separated from the gas space 30, thereby stirring with foaming less likely to occur.

Here, the powder drug and the liquid drug are different from each other in mass or density, and accordingly, respective moving speeds thereof in the drug container 21 are different from each other. The rotational motion and the vibrational motion are combined with each other as in the third step S300 of the first embodiment, thereby a difference between the respective moving speeds is increased, and shearing force by friction generated between the powder and the liquid can be enhanced. Therefore, by performing the third step S300, stirring or dissolution in a short time also becomes possible.

Note that, heretofore, a stirring method accompanied with the foaming has been used in order to obtain high stirring force, and accordingly, a decompression device or the like for performing defoaming has been necessary. However, in the first embodiment, it is possible to perform the stirring work so as not to cause the foaming, and accordingly, the decompression device or the like for performing the defoaming is unnecessary, and a stirring apparatus, which is simple and compact, can be made.

Subsequently, with reference to FIG. 1, a description is made of a schematic configuration and basic operation of the stirring apparatus 20 of the first embodiment.

As shown in FIG. 1, the stirring apparatus 20 of the first embodiment includes at least: the container support unit 22; a rotation mechanism unit 25; a vibration mechanism unit 26; and a control unit 41. The container support unit 22 supports the drug container 21 with a cylindrical shape.

The rotation mechanism unit 25 rotates the container support unit 22 about the central axis 23 thereof. For example, the rotation mechanism unit 25 is made of a motor.

The vibration mechanism unit 26 reciprocally moves the container support unit 22 along the central axis 23 thereof, and thereby reciprocally vibrates the container support unit 22. For example, the vibration mechanism unit 26 is made of a motor and a publicly known conversion mechanism that converts a rotational motion into a linear motion. The vibration mechanism unit 26 as described above converts a rotational motion by rotation of the motor into a linear motion through the publicly known conversion mechanism, and reciprocally vibrates a stirring unit 28 and a stirring support base 29 in a direction of an arrow 29*a* that extends along the central axis 23.

The control unit 41 controls operation of the respective components of the stirring apparatus 20 of the first embodiment. Note that the following description is made while omitting the fact that the operations of the respective components are controlled by the control unit 41.

As shown in FIG. 1, the container support unit 22 of the stirring apparatus 20 of the first embodiment supports the drug container 21 such as a vial container in a laterally laid state along the horizontal direction 23*a*. Specifically, from both right and left sides, the container support unit 22 sandwiches and supports a bottom portion 21*b* and a port portion 21*c* of the drug container 21 by a disc-like first support portion 22*a* on a port portion 21*c* side and a disc-like second support portion 22*b* on a bottom portion 21*b* side. The first support portion 22*a* and the second support portion 22*b* are connected to each other by a transparent cylindrical connection portion 22*c*. Moreover, the first support portion 22*a* is coupled to a rotating shaft 25*a* of the rotation mechanism unit 25. Therefore, rotational drive force of the rotating shaft 25*a* is transmitted to the first support portion 22*a*, and the rotating shaft 25*a* and the first support portion 22*a* rotate integrally with each other in forward and reverse directions. For example, the container support unit 22 and the rotation mechanism unit 25 are housed in the box-like stirring unit 28, and are supported on at least either of sidewalls 28*a* of the stirring unit 28. By a bearing member 70, the container support unit 22 is supported so as to be rotatable with respect to the sidewalls 28*a* of the stirring unit 28. The stirring unit 28 is supported by the stirring support base 29 located thereunder. The stirring unit 28 and the stirring support base 29 are supported on a support base 27 of the stirring apparatus 20 through the vibration mechanism unit 26 such as a slider so as to be advanceable and retreatable in an axial direction of the rotation.

As mentioned above, the stirring apparatus 20 of the first embodiment first rotates the rotating shaft 25*a* by the rotation mechanism unit 25, and thereby rotates the drug container 21, which is supported by the container support unit 22, about the central axis 23 in a direction of an arrow 21*d* (second step S200). Here, the drug container 21 rotates about the central axis 23, thereby the drug solution 24 and the gas space 30 are separated from each other to an outer circumference side (inner side surface 21*a* side) of the container and a center side thereof, respectively, in an inside of the container 21. Subsequently, the stirring apparatus 20 operates the vibration mechanism unit 26 while keeping on rotating the drug container 21 by the rotation mechanism unit 25, and thereby reciprocally vibrates the stirring unit 28 and the stirring support base 29 in the direction of the arrow 29*a* that extends along the central axis 23 (third step S300). The rotational motion and the vibrational motion are combined with each other as described above, thereby such a state can be generated as shown in FIG. 1, where the gas space 30 is located on the center portion of the inside of the drug container 21, and the drug solution 24 as a solution layer is located on a region that goes along the inner side surface 21*a*, the bottom portion 21*b*, and the port portion 21*c*. In such a way, the drug solution 24 and the gas space 30 are separated from each other.

Figure 2A:
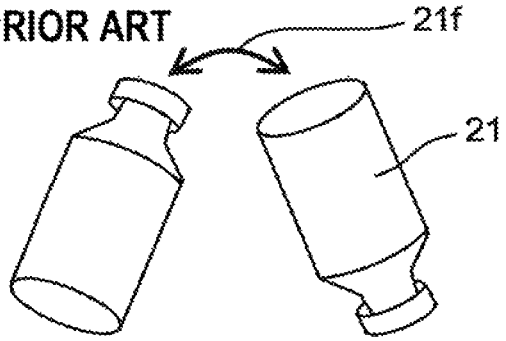
Fig.2A PRIOR ART
FIG. 2A is a perspective view showing a first example (mixing with inversion) of stirring drugs.
Figure 2B:
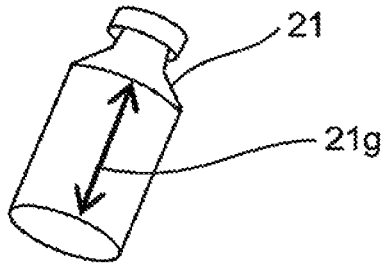
Fig.2B PRIOR ART
FIG. 2B is a perspective view showing a second example (strong shake) of stirring the drugs.
Figure 2C:
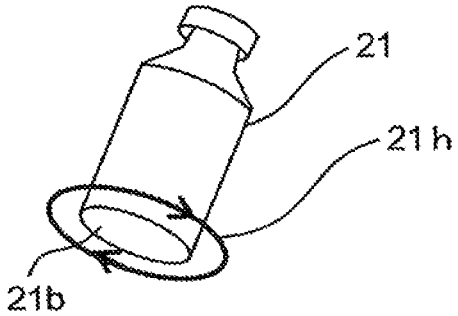
Fig.2C PRIOR ART
FIG. 2C is a perspective view showing a third example (adjustment) of stirring the drugs.

FIG. 2A to FIG. 2C are reference perspective views showing examples of stirring a drug by the hands of a pharmacist or the like. FIG. 2A shows a stirring method called "mixing with inversion", in which the drug container 21 such as the vial container is moved so as to repeat vertical inversion as in an arrow 21*f* for stirring. FIG. 2B shows a stirring method called "strong shake", in which the drug container 21 such as the vial container is shaken so as to be reciprocally moved heavily at a high speed in a direction along an arrow 21*g*. FIG. 2C shows a stirring method called "adjustment", in which the bottom portion 21*b* of the drug container 21 such as the vial container is moved so as to draw a circle at a low speed in a direction along an arrow 21*h*. The pharmacist or the like stirs the powder drug and the liquid drug in the inside of the drug container 21 by using the stirring methods shown in FIG. 2A to FIG. 2C. However, skills are required to stir the drugs so that the drugs can be completely dissolved, and it is difficult to mix the drugs uniformly. Moreover, it takes an extremely long time to uniformly mix an anticancer drug such as docetaxel and cyclophosphamide. Furthermore, it takes an extremely long time to remove bubbles of an anticancer drug such as trastuzumab, which accompany mixing thereof.

The stirring apparatus 20 according to the first embodiment automatically makes it possible to stir the drugs without using the manual stirring methods as described above. Therefore, the stirring apparatus 20 according to the first embodiment can reduce a load on the pharmacist or the like.

Subsequently, the stirring apparatus 20 of the first embodiment is made experimentally, and is compared with a conventional stirring machine in terms of differences therebetween, thereby a description is made of effects of the stirring apparatus 20 of the first embodiment.

Figure 3A:
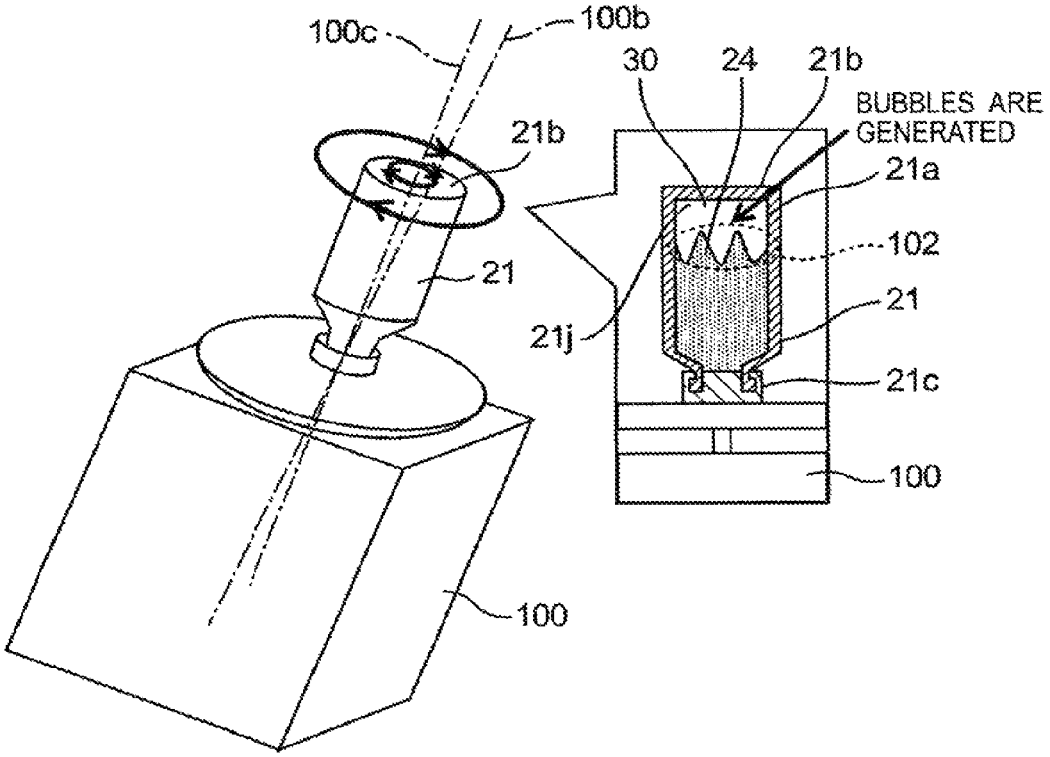
Fig.3A PRIOR ART
FIG. 3A is a perspective view showing a stirring method (eccentric rotation) by a conventional stirring machine.
Figure 3B:
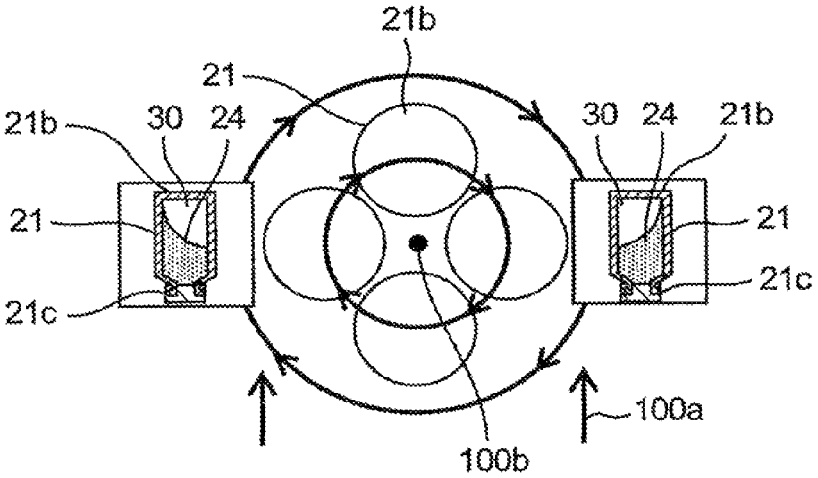
Fig.3B PRIOR ART
FIG. 3B is a plan view showing a stirring method by the conventional stirring machine.
Figure 4A:
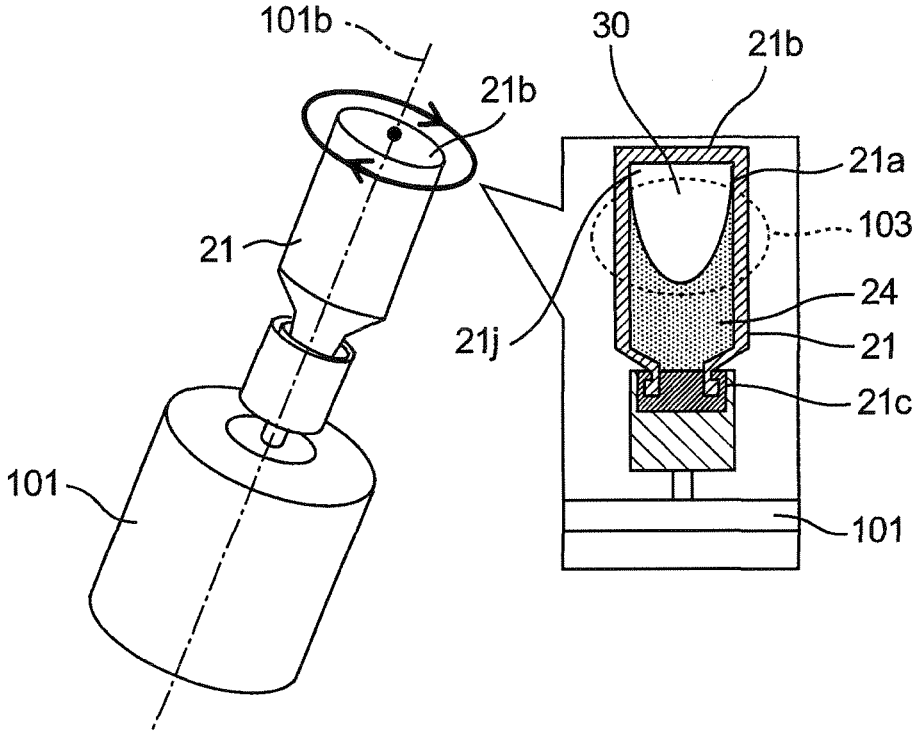
FIG. 4A is a perspective view showing a stirring method (concentric rotation) by a stirring apparatus made experimentally.
Figure 4B:
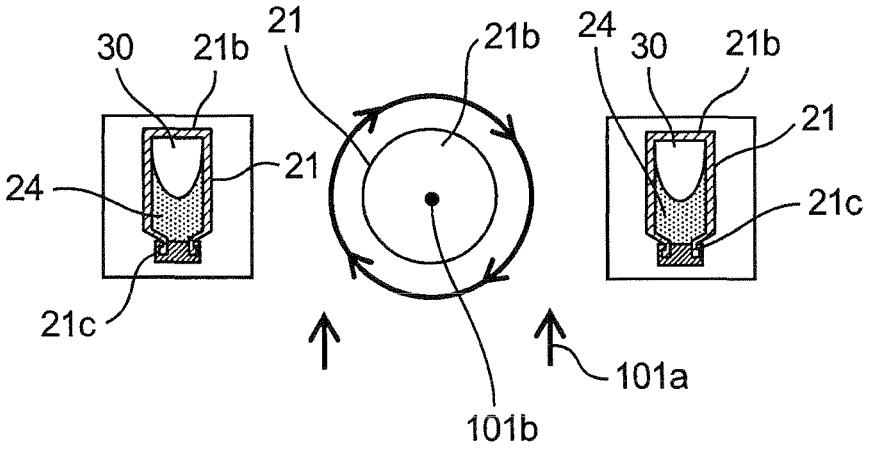
FIG. 4B is a plan view showing the stirring method by the stirring apparatus made experimentally.

FIG. 3A is a perspective view showing a stirring method by a conventional stirring machine 100. FIG. 3B is a plan view showing the stirring method by the conventional stirring machine 100. FIG. 4A is a perspective view showing a stirring method by a stirring machine 101 made experimentally. FIG. 4B is a plan view showing the stirring method by the stirring machine 101 made experimentally. In FIG. 3A and FIG. 4A, cross-sectional views of the drug container 21 in a stirred state are also shown simultaneously. In FIG. 3B and FIG. 4B, cross-sectional views of the drug container 21 when viewed from directions (lateral direction of the drug container 21) of arrows 100*a* and 101*a* are also shown simultaneously.

The conventional stirring machine 100 shown in FIG. 3A is a device that stirs a drug solution by swirling the drug solution at a high speed, for example, by using a Vortex mixer or the like. In the conventional stirring machine 100, the drug container 21 rotates eccentrically as shown in FIG. 3A about a central axis 100*c* made eccentric from a central axis 100*b* of rotation of the stirring machine 100, the central axis 100*c* being taken as a center of symmetry. FIG. 3B is a plan view of a situation of this rotation when viewed from a bottom portion 21*b* side of the drug container 21. In the conventional stirring machine 100, as shown in FIG. 3B, the drug solution 24 is stirred in such a manner that the bottom portion 21*b* of the drug container 21 rotates eccentrically about the central axis 100*b*. At this time, the gas space 30 in the drug container 21 and the drug solution 24 as the solution layer therein are complicatedly mixed with each other as shown in a region 102. Then, the powder drug adhered onto the inner side surface 21*a*, inner bottom surface 21*j* or the like of the drug container 21 is left adhered thereonto, and is not stirred by the drug solution 24. As a result, there is a possibility that the bubbles of the drug solution 24 may be generated in the drug container 21.

Meanwhile, in the stirring machine 101 made experimentally by the inventors, as shown in FIG. 4A, concentric rotation is performed about a central axis 101*b*, and the drug solution 24 in the drug container 21 is stirred. The stirring machine 101 is a machine made experimentally by the inventors in order to verify the effects of the stirring apparatus 20 and the stirring method according to the first embodiment of the present invention. FIG. 4B is a plan view of a situation of this rotation when viewed from the bottom portion 21*b* side of the drug container 21. As shown in FIG. 4B, stirring of the drug container 21 is performed in such a manner that the bottom portion 21*b* is rotated concentrically about the central axis 101*b*. At this time, the gas space 30 in the drug container 21 and the drug solution 24 as the solution layer therein are sufficiently separated from each other. However, since there is a case where the powder drug is adhered onto the inner side surface of the drug container 21, it is necessary to wash the powder drug away by the drug solution 24 in order to stir the powder drug more reliably.

Accordingly, in the first embodiment, the stirring apparatus 20 shown in FIG. 1 is used, thereby not only the gas space 30 and the drug solution 24 as the solution layer are sufficiently separated from each other, but also the drug solution 24 is moved along the inner side surface 21*a* of the drug container 21 including the port portion 21*c* and the bottom portion 21*b*. The stirring apparatus 20 is operated as described above, thereby the powder drug adhered onto the inner side surface 21*a* of the drug container 21 can be washed away by the drug solution 24, and can be reliably mixed therewith.

Moreover, at the time when the drug solution 24 rotates along the inner side surface 21*a*, the powder drug rotates together with the drug solution 24 that rotates by receiving the centrifugal force, and at the same time, is pulled in the vertical direction by receiving an influence of the gravity. In such a way, the shearing force by the friction is enhanced between the powder drug and the drug solution 24, and accordingly, the stirring and the dissolution in a short time are possible. This is an effect of arranging the drug container 21 so that the central axis 23 thereof can extend along the horizontal direction 23*a*.

Figure 5:
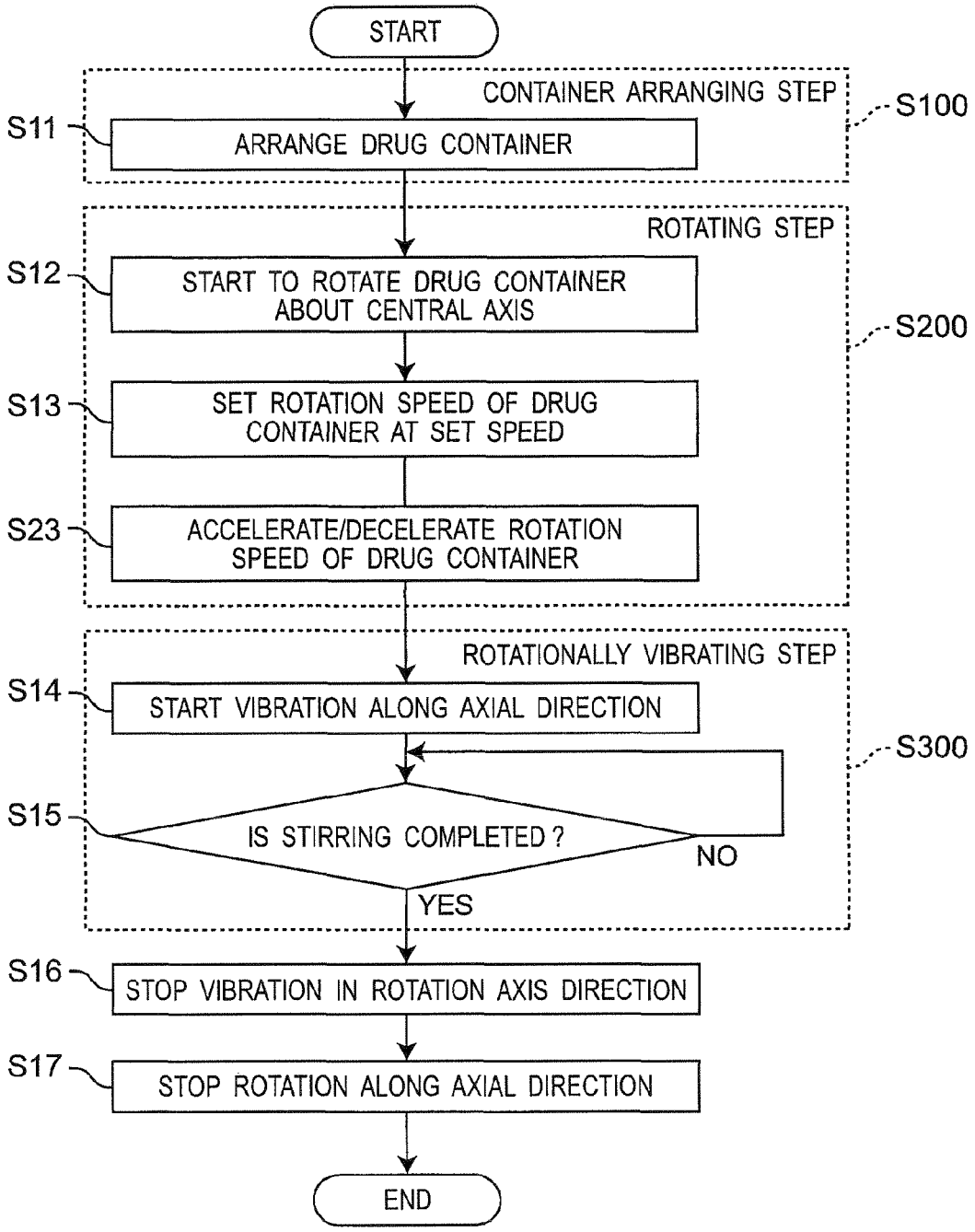
FIG. 5 is a flowchart showing a stirring method according to the first embodiment of the present invention.
Figure 6A:
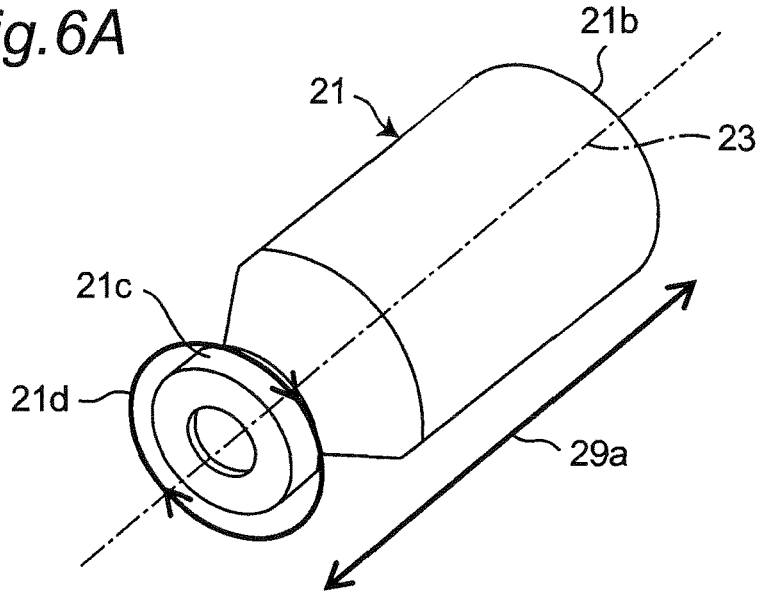
FIG. 6A is a view for explaining a rotation or vibration direction of a drug container in the first embodiment of the present invention.
Figure 6B:
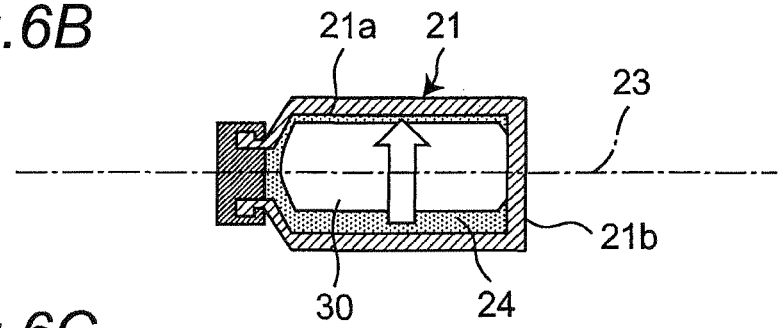
FIG. 6B is a view for explaining a state of a drug solution in an inside of the drug container in the first embodiment of the present invention.
Figure 6C:
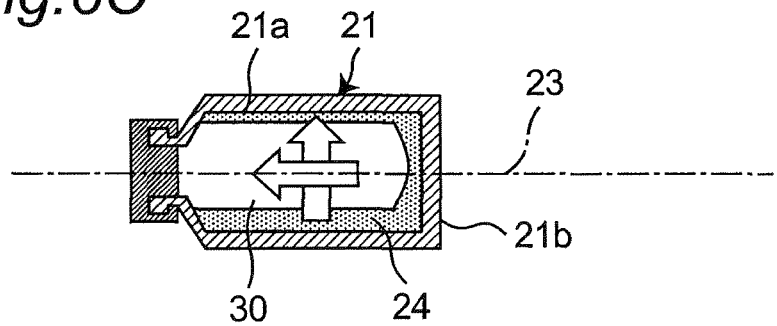
FIG. 6C is a view for explaining the state of the drug solution in the inside of the drug container in the first embodiment of the present invention.
Figure 6D:
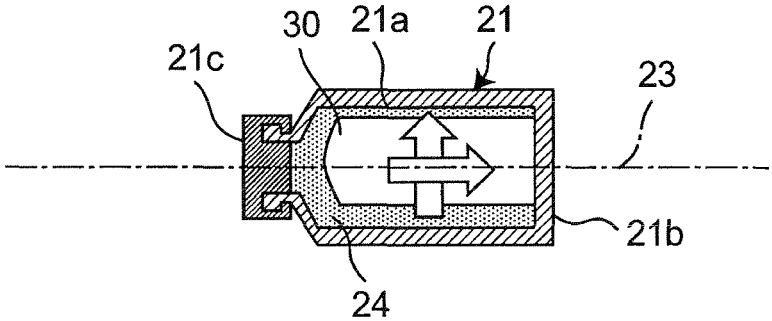
FIG. 6D is a view for explaining the state of the drug solution in the inside of the drug container in the first embodiment of the present invention.

FIG. 5 is a flowchart of the stirring method using the stirring apparatus 20 according to the first embodiment of the present invention. FIG. 6A is a view for explaining rotation and vibration directions of the drug container 21 in the stirring method according to the first embodiment of the present invention. FIG. 6B, FIG. 6C, and FIG. 6D are views for explaining states of the drug solution 24 in the inside of the drug container 21 in the stirring method according to the first embodiment of the present invention. With reference to FIG. 5 to FIG. 6D, a description is specifically made of the stirring method of the first embodiment.

As shown in FIG. 5, first, the drug container 21 is arranged on and fixed to the container support unit 22 shown in FIG. 1 by the hands of the pharmacist or the like (step S11). The drug container 21 is, for example, a vial container with a capacity of 30 ml.

Next, under the control of the control unit 41, the rotation mechanism unit 25 is driven to start the rotation of the drug container 21 about the central axis 23 (step S12).

Next, under the control of the control unit 41, the rotation mechanism unit 25 is driven to set a rotation speed of the drug container 21 at a set speed (step S13). The set speed is a speed that can give such centrifugal force as allowing the drug solution 24 to go along the inner side surface 21*a* of the drug container 21, and for example, is 1000 rpm. The set speed is the speed that can give the centrifugal force, and accordingly, the set speed desirably ranges from 500 rpm or more to 3000 rpm or less. The set speed is calculated in advance and stored in a storage unit 41*a* in advance. A configuration of controlling the rotation speed is a configuration known in public, and for example, the number of revolutions of the rotation mechanism unit 25 is detected by a sensor such as an encoder, and a drive signal for the rotation mechanism unit 25 is controlled based on the number of revolutions, which is detected by the sensor.

Figure 7:
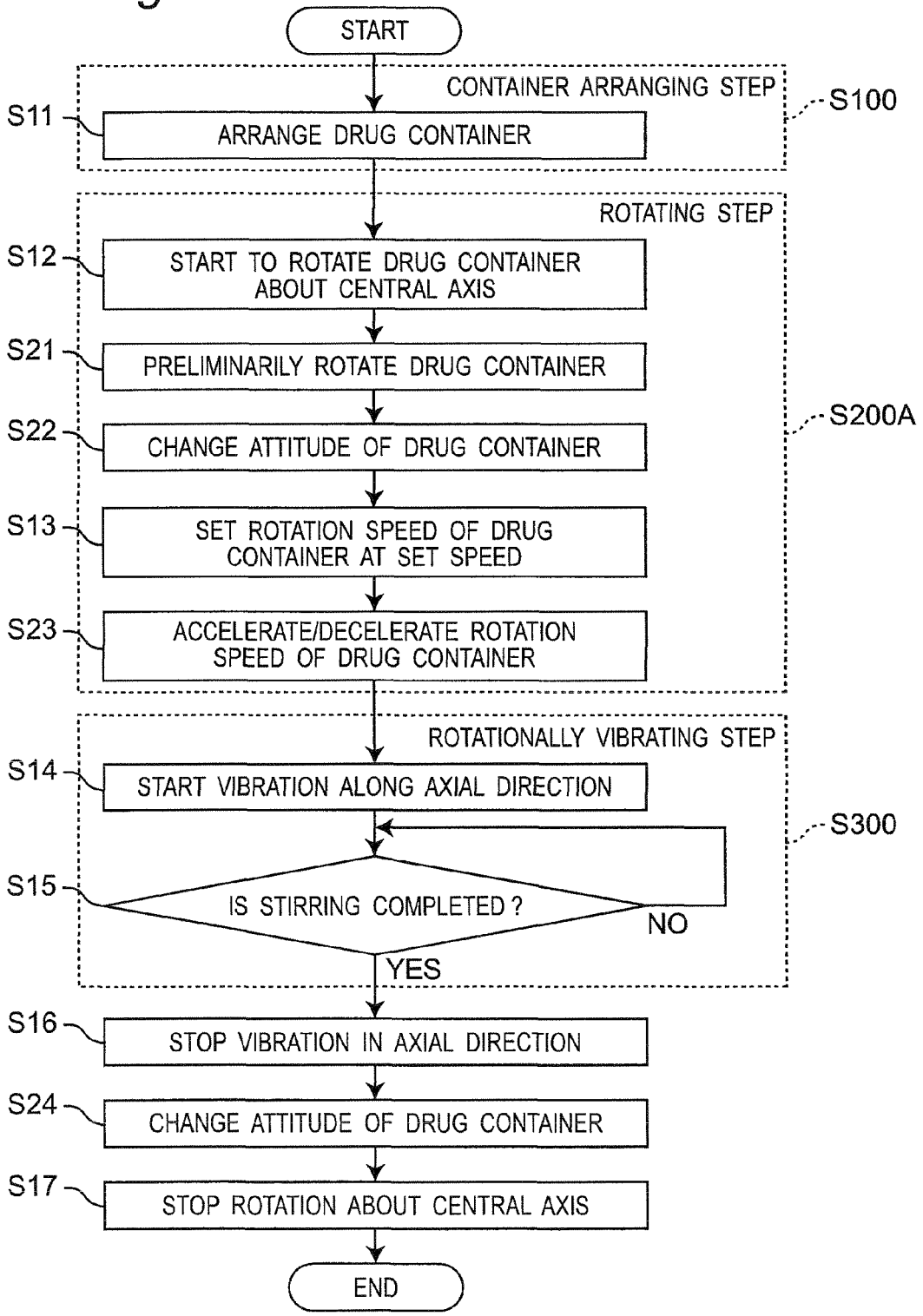
FIG. 7 is a flowchart of a stirring method according to a second embodiment of the present invention.

Next, the rotation speed is accelerated and decelerated, thereby the shearing force by the friction between the powder and the liquid is further increased (step S23 of FIG. 7).

Figure 10A:
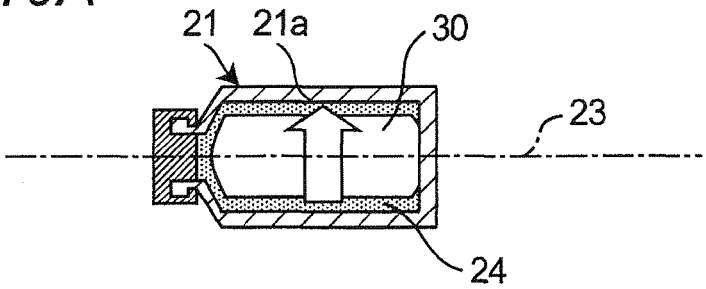
FIG. 10A is a view for explaining a method of stirring the drug solution by accelerating or decelerating a rotation speed in the first embodiment of the present invention.
Figure 10B:
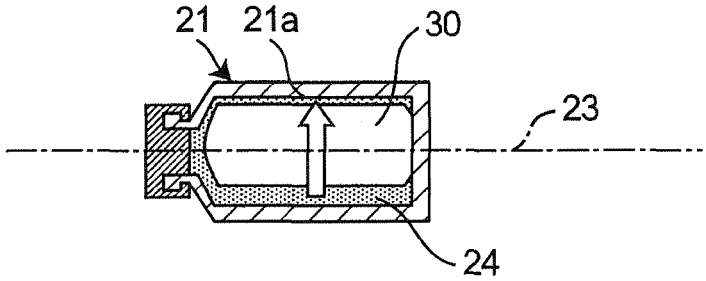
FIG. 10B is a view for explaining the method of stirring the drug solution by accelerating or decelerating the rotation speed in the first embodiment of the present invention.
Figure 10C:
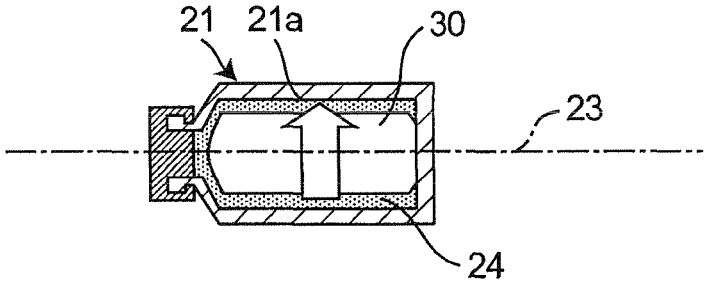
FIG. 10C is a view for explaining the method of stirring the drug solution by accelerating or decelerating the rotation speed in the first embodiment of the present invention.
Figure 10D:
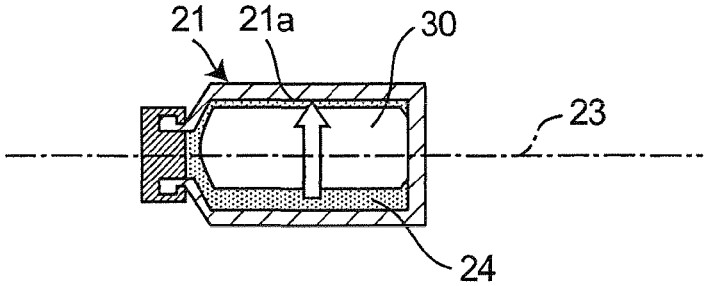
FIG. 10D is a view for explaining the method of stirring the drug solution by accelerating or decelerating the rotation speed in the first embodiment of the present invention.

Here, at the time of accelerating or decelerating (accelerating and decelerating) the rotation speed in step S23 in a second step S200A (step S23 in FIG. 7), as shown in FIG. 10A to FIG. 10D, with regard to the drug solution 24, an amount thereof in a vertically upward direction (upward direction of FIG. 10A and FIG. 10C) is increased in states where the rotation speed is high and the centrifugal force is large (states of FIG. 10A and FIG. 10C), and the amount thereof in the vertically upward direction (upward direction of FIG. 10B and FIG. 10D) is decreased in states where the rotation speed is low and the centrifugal force is small (states of FIG. 10B and FIG. 10D). By repeating these states, the motion of the drug solution 24 can be made intense, and the drug solution 24 and the powder drug can be further mixed with each other. As an example, with regard to the rotation speed, the drug container 21 was rotated at 1500 rpm in usual, was rotated at 2000 rpm at the time of acceleration (states of FIG. 10A and FIG. 10C), and was rotated at 1000 rpm at the time of deceleration (states of FIG. 10B and FIG. 10D). Note that, by an experiment by the inventors, it is found out that a region where the drug solution 24 does not partially go along the inner side surface 21*a* of the drug container 21 is generated when the rotation speed falls down below 900 rpm. Moreover, by an experiment of the inventors in a similar way, it is found out that, when the rotation speed exceeds 3000 rpm, there occurs a fear that the drug container 21 such as the vial container may be damaged. Therefore, desirably, the rotation speed at the time of acceleration is set at 3000 rpm or less, and the rotation speed at the time of deceleration is set at 900 rpm or more.

Next, under the control of the control unit 41, while maintaining the rotation in the rotation mechanism unit 25, the vibration of the drug container 21 is started in the direction (rotation axis direction) along the central axis 23 of the drug container 21, by the vibration mechanism unit 26 (step S14) As an example, such reciprocal vibration in step S14 is started after the elapse of one to two seconds since the rotation speed reaches the set speed in step S13. Here, if control to accelerate/decelerate a vibration speed by the control unit 41 is added in step S14, the shearing force by the friction between the powder drug and the drug solution 24 can be increased, and the powder drug and the drug solution 24 can be stirred at a higher speed.

In such a way, under the control of the control unit 41, the rotational motion and the vibrational motion are performed simultaneously, and these motions are continued until the above-described stirring is completed (NO in step S15).

Then, when the powder drug such as the anticancer drug in the inside of the drug container 21 is dissolved into the drug solution 24 under the control of the control unit 41, and the stirring is ended (YES in step S15), then under the control of the control unit 41, the reciprocal vibration of the drug container 21 in the direction along the central axis 23 of the rotation is stopped (step S16). Here, under the control of the control unit 41, the completion of the stirring can be confirmed, for example, by a method of performing the stirring for a predetermined time based on a stirring time calculated in advance by an experiment and the like, or a method of capturing the inside of the drug container 21 by a camera (not shown), or the like.

Next, under the control of the control unit 41, the rotation of the drug container 21 is stopped by the rotation mechanism unit 25 (step S17) in a state where the vibration is stopped, and the stirring is ended. In the first embodiment, in the event of ending the stirring, the rotation is stopped after the vibration is stopped as in steps S16 and S17. The vibration and the rotation are stopped in this order, thereby the foaming of the drug solution 24 in the drug container 21 can be prevented even in the event of stopping the movement of the drug solution 24.

In FIG. 5, step S11 is the first step S100 mentioned above, steps S12 and S13 are the second step S200 mentioned above, and steps S14 and S15 are the third step S300 mentioned above.

With regard to the stirring of the drug solution 24, which is performed as mentioned above, situations of the inside of the drug container 21 in the respective states are described with reference to FIG. 6A to FIG. 6D. FIG. 6A is a perspective view of the drug container 21 of the first embodiment. FIG. 6B is a cross-sectional view showing the situation of the inside of the drug container 21 in the second step S200. FIG. 6C and FIG. 6D are cross-sectional views showing the situations of the inside of the drug container 21 in the third step S300.

First, in the second step S200, as shown in FIG. 6B, a rotation direction shown by the arrow 21*d* is set about the central axis 23 of the drug container 21, and the drug container 21 is rotated in the direction of the arrow 21*d*. In such a way, along the inner side surface 21*a* of the drug container 21, the drug solution 24 rotates in the vicinity of the inner side surface 21*a*.

Subsequently, in the third step S300, as shown in FIG. 6C, for the drug container 21, a vibrational motion (movement of the drug container 21 to a left side of FIG. 6C) is started together with the rotational motion. Then, the drug solution 24 moves to a right side along the central axis 23, and the drug solution 24 collects to the vicinity of the bottom portion 21*b* of the drug container 21. Moreover, in the third step S300, as shown in FIG. 6D, a vibrational motion (motion to a right side of FIG. 6D) is started together with the rotational motion. Then, the drug solution 24 moves to a left side along the central axis 23, and the drug solution 24 collects to the vicinity of the port portion 21*c* of the drug container 21. For example, in the case of rotating the drug container 21 at 1000 rpm, desirably, amplitude of the vibrational motion is set at 50 mm, and a cycle thereof is set at 3 Hz. The state of FIG. 6C and the state of FIG. 6D are repeated alternately, and the drug container 21 is vibrated while being rotated, thereby such a situation where the powder drug is adhered to any of the sidewalls of the drug container 21 and remains without being stirred can be eliminated, and the powder drug and the drug solution 24 can be mixed and stirred with each other.

Hence, in accordance with the first embodiment, a compact structure that does not require a mechanism for removing bubbles can be formed. The structure is so compact as to be installable also in a space (for example, an inside of a safety cabinet or the like) of work, for which safety is considered in a hospital, the work including, for example, mixing of the drug such as the anticancer drug. Moreover, the stirring and mixing of the drug can be reliably carried out while the drug is being left in the drug container.

(Second Embodiment)

In comparison with the above-mentioned first embodiment, a second embodiment of the present invention is different therefrom in a part of the flow of the stirring method, and in that a stirring apparatus 50 includes an attitude change mechanism 60 and an attitude control unit 51 for changing an attitude of the drug container 21. Therefore, in the second embodiment, a description is made only of contents regarding such differences thereof from the first embodiment mentioned above, and a description of others is omitted. Note that the control unit 41 controls the attitude control unit 51, which controls the later-described attitude change mechanism 60 of the second embodiment, and thereby also controls attitude change operation.

FIG. 7 is a flowchart of a stirring method of the second embodiment.

As shown in FIG. 7, in comparison with the stirring method of the first embodiment mentioned above, the stirring method of the stirring apparatus 50 of the second embodiment is characterized in that the following steps are added, which are: step S21 as a step of preliminarily rotating the drug container 21; step S22 as a step of changing the attitude of the drug container 21 from a vertically inverted state to a horizontal state by the attitude change mechanism 60; step S23 as a step of accelerating/decelerating the rotation speed of the drug container 21; and step S24 as a step of changing the attitude of the drug container 21 from the horizontal state to the vertically inverted state by the attitude change mechanism 60. Steps other than the steps thus added are similar to those of the first embodiment, and accordingly, a description is made mainly of these added steps.

By these steps S21 to S24, the drug container 21 is supported in the vertically inverted state on the container support unit 22, and while rotating the drug container 21 in this vertically inverted state, the attitude of the drug container 21 is changed from the vertically inverted state to the horizontal state for stirring. The drug container 21 is installed and detached in such a vertically inverted state as described above, thereby it becomes easy to install and detach the drug container 21.

Circumstances of the stirring apparatus 50 at the time of the attitude change are described with reference to FIG. 8A and FIG. 8B.

Figure 8A:
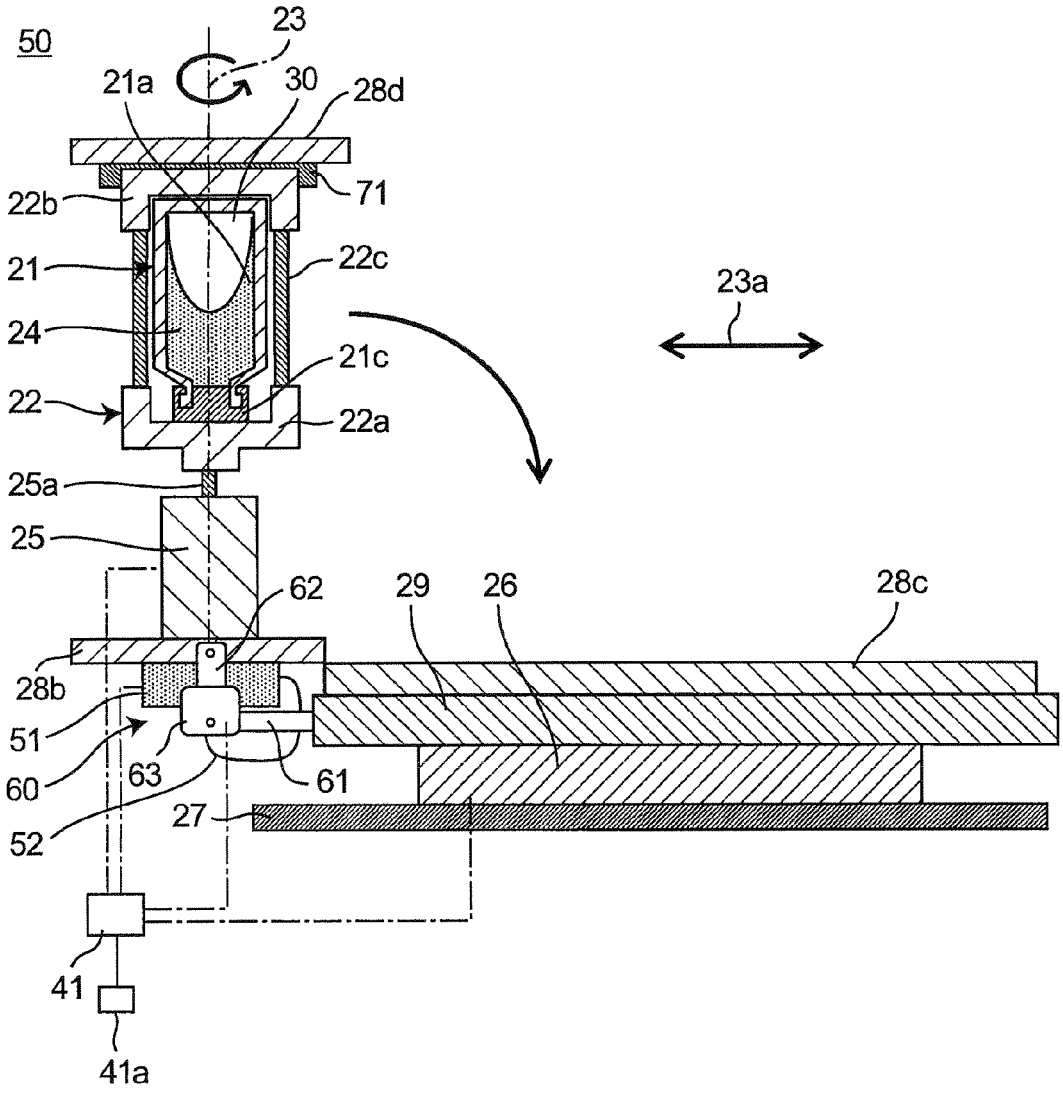
FIG. 8A is a cross-sectional view for explaining an attitude change of the drug container in the second embodiment of the present invention.

As shown in FIG. 8A, a basic configuration of the stirring apparatus 50 of the second embodiment is similar to that of the stirring apparatus 20 of the first embodiment.

Figure 8B:
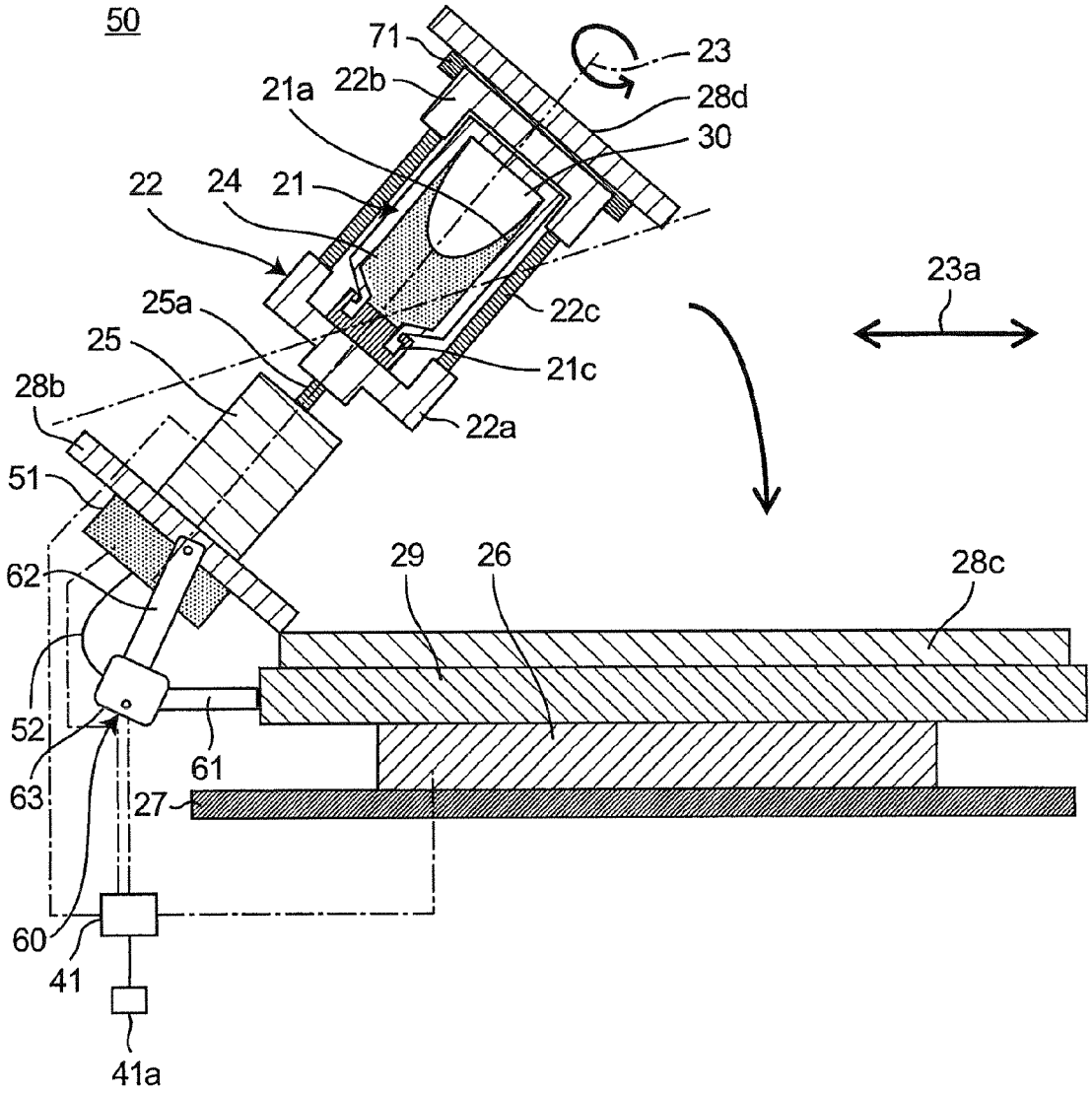
FIG. 8B is a cross-sectional view for explaining the attitude change of the drug container in the second embodiment of the present invention.

As shown in FIG. 8A and FIG. 8B, the attitude change mechanism 60 controlled by the attitude control unit 51 changes the attitude of the drug container 21 from a horizontal attitude (horizontal state), in which the drug container 21 is arranged so that the central axis 23 of the drug container 21 can extend along the horizontal direction 23*a*, to a vertically inverted attitude (vertically inverted state), in which the drug container 21 is arranged so that the central axis 23 of the drug container 21 can extend along a vertical direction 23*b*.

The attitude change mechanism 60 includes an air cylinder 63 that functions as an example of an attitude changing drive device. To a first sidewall 28*b*, for example, a tip end of a piston rod 62 of the air cylinder 63 is coupled so as to be rotatable, and with regard to a second sidewall 28*c*, to a tip end of a support bar 61 that protrudes along a longitudinal direction thereof, a base end of the air cylinder 63 is coupled so as to be rotatable.

For example, the attitude control unit 51 is attached to an outer surface of the first sidewall 28*b* of the stirring unit 28, is electrically connected to the air cylinder 63 by a wire 52, and controls the air cylinder 63. The air cylinder 63 is controlled by the attitude control unit 51, thereby the attitude of the drug container 21 can be changed between the vertically inverted state thereof and the horizontal state thereof while keeping on rotating the drug container 21.

A description is made below of attitude change operation under control of the attitude control unit 51 together with the stirring operation under the control of the control unit 41. Note that step S11 of FIG. 7 is the first step S100. Steps S12, S21, S22, S13, and S23 of FIG. 7 are the second step S200A. Steps S14 and S15 of FIG. 7 are the third step S300.

Figure 9A:
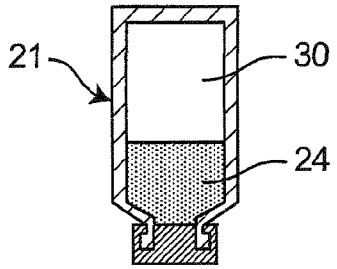
FIG. 9A is a view for explaining a state of the drug solution or the like in an inside of the drug container when the attitude thereof is changed in the second embodiment of the present invention.

First, as shown in FIG. 8A, the pharmacist attaches the drug container 21 to the container support unit 22 in the vertically inverted attitude (vertically inverted state) in which the port portion 21*c* is located downward (step S11 of FIG. 7, state of FIG. 9A)

Figure 9B:
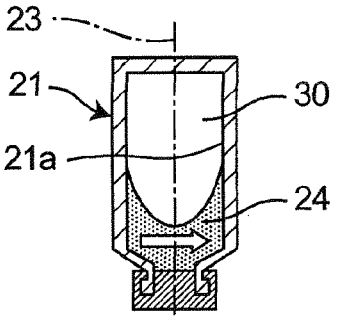
FIG. 9B is a view for explaining a state (axial rotation starting state) of the drug solution or the like in the inside of the drug container when the attitude thereof is changed in the second embodiment of the present invention.

Subsequently, the container support unit 22 is started to be rotated about the central axis 23 together with the drug container 21 (step S12 of FIG. 7). When it is determined by the control unit 41 that the rotation speed of the container support unit 22 has reached a preliminary rotation speed as a predetermined speed (step S21 of FIG. 7, state of FIG. 9B), then the operation proceeds to next step S22. Step S21 is a step of rotating the drug container 21 in the vertically inverted attitude about the central axis 23 at a predetermined preliminary rotation speed, and thereby moving the drug solution 24 in the drug container 21 along the inner side surface 21*a* of the drug container 21 by the centrifugal force. Here, the preliminary rotation speed refers to a rotation speed at which the drug solution 24 in the drug container 21 is not ruffled even if the attitude of the drug container 21 is changed. Moreover, the preliminary rotation speed is a speed slower than a usual speed of rotation as the rotation for the stirring.

Subsequently, in step S22, the drive of the air cylinder 63 is controlled under the control of the attitude control unit 51, thereby the attitude of the container support unit 22 is changed from the vertically inverted attitude to the horizontal attitude (step S22 of FIG. 7, state of FIG. 9C). That is, step S22 is a step of changing the attitude of the drug container 21 by the attitude change mechanism 60 after step S21 as a preliminary rotation step. In step S22, as an example, after the elapse of one to two seconds (after the rotation turns to a stationary state) since the start of step S21 as the preliminary rotation step, the attitude of the container support unit 22 is changed. As a modification example of step S22, it is also possible to change the attitude of the container support unit 22 while rotating the same.

Subsequently, in a similar way to the first embodiment, the rotation speed of the drug container 21 is set at the set speed, for example, 1000 rpm, which can give such centrifugal force as allowing the drug solution 24 to go along the inner side surface 21*a* of the drug container 21 (step S13 of FIG. 7).

Subsequently, the rotation speed is accelerated/decelerated, thereby the shearing force by the friction between the powder and the liquid is further increased (step S23 of FIG. 7).

Subsequently, the container support unit 22 is vibrated in a state of being rotated, and stirring of the drug container 21 is performed (step S14 of FIG. 7).

Figure 9C:
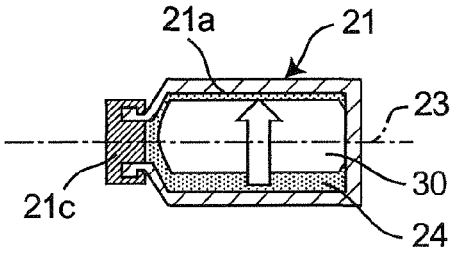
FIG. 9C is a view for explaining a state (stirred state where axis is rotated by 90 degrees) of the drug solution or the like in the inside of the drug container when the attitude thereof is changed in the second embodiment of the present invention.

When it is determined by the control unit 41 that such stirring of the drug container 21 is completed (step S15 of FIG. 7), then under the control of the control unit 41, the drive of the vibration mechanism unit 26 is stopped, and first, the vibration of the container support unit 22 in the rotation axis direction is stopped (step S16 of FIG. 7, state of FIG. 9C).

Figure 9D:
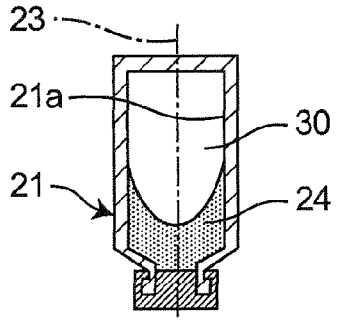
FIG. 9D is a view for explaining a state (where axis is further rotated by 90 degrees) of the drug solution or the like in the inside of the drug container when the attitude thereof is changed in the second embodiment of the present invention.

Thereafter, the air cylinder 63 is driven under the control of the attitude control unit 51, and the attitude of the drug container 21 is changed from the horizontal attitude to the vertically inverted attitude together with that of the container support unit 22 (step S24 of FIG. 7, state of FIG. 9D). As an example, after the elapse of one to two seconds (after inertia of the vibration goes off) since the stop of the vibration in step S16, such an attitude change in step S24 is performed.

Figure 9E:
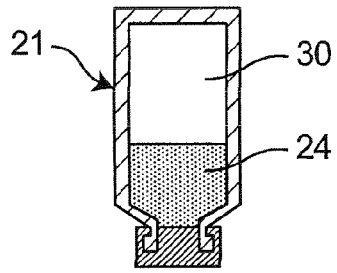
FIG. 9E is a view for explaining a state (stop of rotation) of the drug solution or the like in the inside of the drug container when the attitude thereof is changed in the second embodiment of the present invention.

Thereafter, the drive of the rotation mechanism unit 25 is stopped under the control of the control unit 41, and the rotation of the container support unit 22 about the central axis 23 is stopped (step S17 of FIG. 7, state of FIG. 9E).

(Third Embodiment)

In a third embodiment of the present invention, a description is made of a stirring apparatus 20A and a stirring method, which are suitable for the case of stirring and mixing a second drug prone to foam and a solution in comparison with that of the first embodiment mentioned above.

For example, the second drug prone to foam is a frozen desiccant. For example, as the freezing descant, Abraxane (generic name: paclitaxel) is mentioned in particular. For example, the solution is physiological salt solution.

Here, with regard to the mixture of the second drug and the solution, a conventional method is described. At the time of manually stirring the second drug and the solution, which are as described above, first, the solution is slowly poured into the drug container 21 so as not to directly fall on a lump of the second drug therein. Subsequently, the drug container 21 is left at rest (stationarily), for example, for five minutes, and the solution penetrates the lump of the second drug. This penetration is performed in order to bring the lump of the second drug to a sufficiently wetted state as a result that the solution penetrates the lump of the second drug. Subsequently, like drawing a circle, the drug container 21 is slowly rotated so as not to foam the solution, and the solution is stirred. If the solution is foamed here, it is difficult to defoam the solution, and accordingly, it is necessary to pay attention to such handwork.

The third embodiment provides the stirring method and the stirring apparatus 20A, which are suitable for the stirring and mixing of the second drug as described above, in particular, Abraxane (generic name: paclitaxel).

Figure 11:
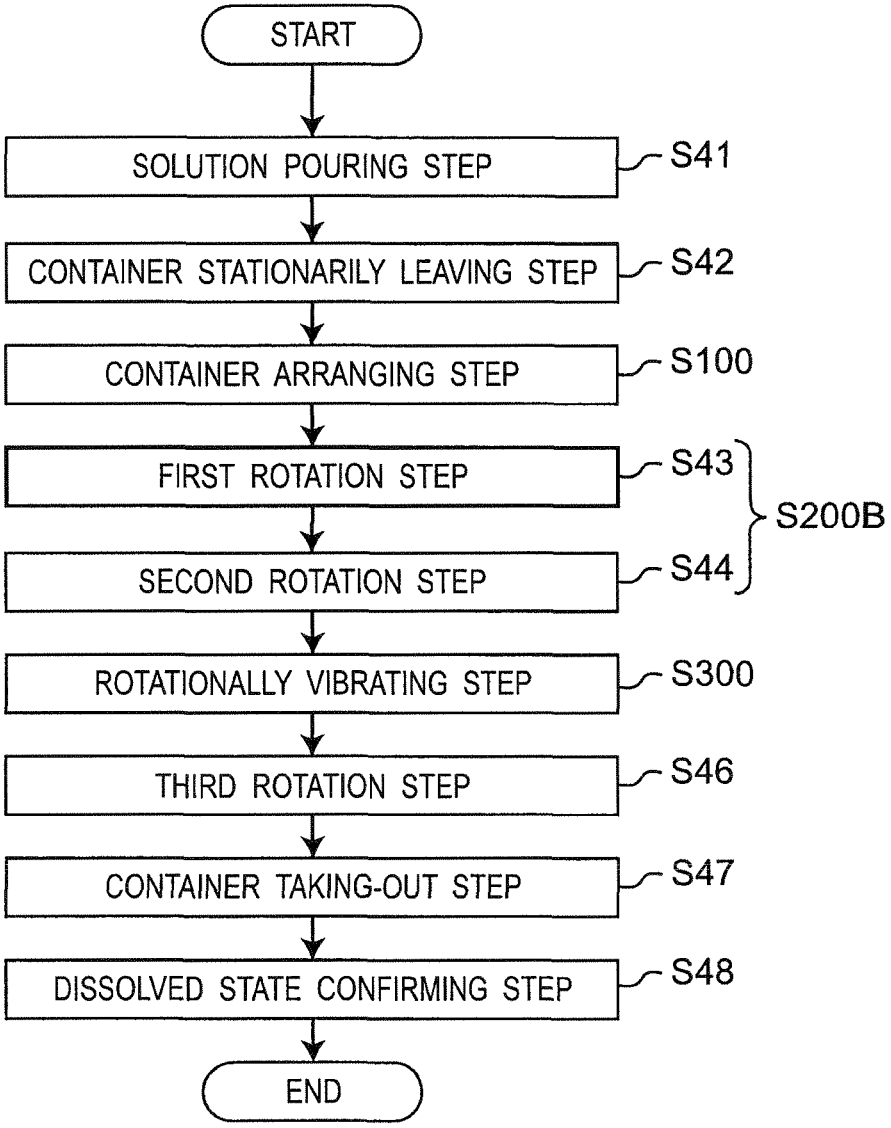
FIG. 11 is a flowchart of a stirring method according to a third embodiment of the present invention.
Figure 12:
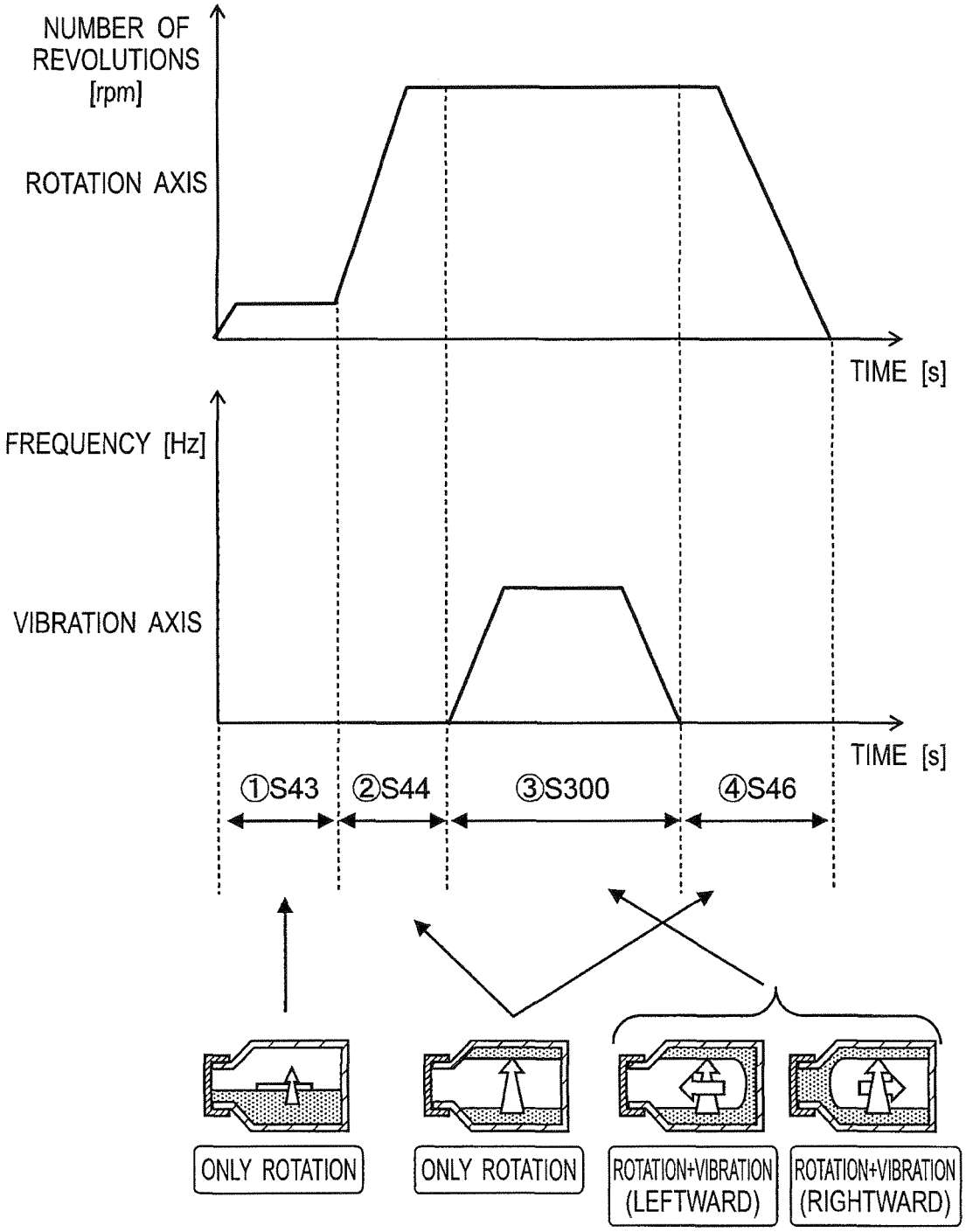
FIG. 12 is an explanatory view for explaining drive control signals and states in respective steps in the third embodiment of the present invention.
Figure 14:
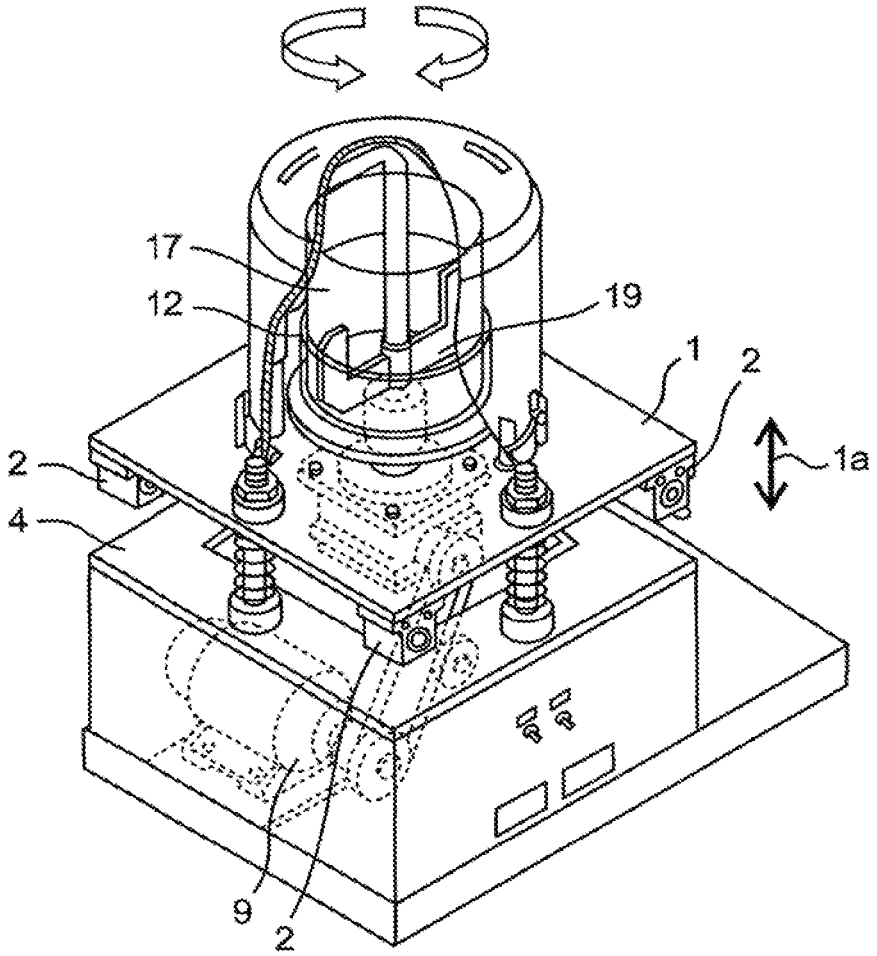
Fig.14 PRIOR ART
FIG. 14 is a perspective view showing a conventional mixing device.

A basic configuration of the stirring apparatus 20A (see FIG. 1) of this third embodiment is the same as that of the stirring apparatus 20 of the first embodiment, and a different points in the third embodiment is contents of operation control for the rotation mechanism unit 25 and the vibration mechanism unit 26 by the control unit 41. Hereinafter, based on a flowchart in FIG. 11, which shows the stirring method of the third embodiment, and on an explanatory view of drive control signals in FIG. 12, a control operation different from that of the first embodiment is described while describing the stirring method of the third embodiment. Note that the drive control signals of FIG. 12 are signals coming from the control unit 41, and are signals for the operation control, which control the number of revolutions (rpm) of the rotating shaft in the rotation mechanism unit 25 and a frequency (Hz) of a vibrating shaft in the vibration mechanism unit 26. Moreover, as illustrated in a lower part of FIG. 12, reference numerals 1 to 4 denote time domains corresponding to first rotation step S43 to third rotation step S46 which will be described later.

First, before the first step S100 of the first embodiment, a solution pouring step S41 and a container stationarily leaving step S42 are performed. In the solution pouring step S41, the solution is poured into the drug container 21, which contains the lump of the second drug, so as to go along an inner wall surface of the drug container 21. Subsequently, in the container stationarily leaving step S42, the drug container 21, into which the solution is poured, is left stationarily for a predetermined time.

Subsequently, in the first step S100 (container arranging step), the drug container 21 is arranged on the container support unit 22 so that the central axis 23 thereof can extend along the horizontal direction 23*a*.

Subsequently, in a second step S200B, the container support unit 22 is rotated about the central axis 23 so that the drug solution 24 in the drug container 21 can be separated from the gas space 30 in the drug container 21 and rotated along the inner side surface 21*a* of the drug container 21. This second step S200B includes the first rotation step S43 and the second rotation step S44. The first rotation step S43 is an example of a penetrating rotation step, and the second rotation step S44 is an example of a stirring rotation step. A rotation speed at the time of the first rotation step S43 is a first rotation speed, and a rotation speed at the time of the second rotation step S44 is a second rotation speed.

The first rotation step S43 is a step of performing a penetrating operation for allowing the solution to penetrate the lump of the second drug. In the first rotation step S43, the drug container 21 is rotated at a low speed in order to allow the solution to penetrate the lump of the second drug. Specifically, the first rotation speed in the first rotation step S43 is slowed down more than the second rotation speed in the second rotation step S44 and the third step S300 (rotationally vibrating step), which will be described later. The first rotation speed is set at such a low rotation speed, thereby the lump of the second drug does not rotate in conjunction with (integrally with) the drug container 21, and the solution can be slowly fallen on the lump of the second drug from the above. As an example, the rotation speed in the first rotation step S43 ranges from 20 rpm or more to 100 rpm or less, and the drug container 21 is accelerated or decelerated in such a range of the rotation speed. A reason why the rotation speed in the event of allowing the solution to penetrate the second drug is set at 20 rpm or more is that at least a rotation speed of 20 rpm is required to fall the solution on the second drug from the above and to allow the solution to penetrate the second drug. If the rotation speed is less than 20 rpm, the solution does not fall on the second drug, and it takes a time to allow the solution to penetrate the lump of the second drug. Moreover, a reason why the rotation speed is set at 100 rpm or less is in order to prevent the lump of the second drug from rotating in conjunction with (rotating integrally with) the drug container 21. If the lump of the second drug rotates in conjunction with the drug container 21, like a paddle, the lump of the second drug stirs the solution in the inside of the drug container 21, and foams the solution.

Subsequently, in a similar way to step S13 of the first embodiment, the second rotation step S44 is a step of rotating the container support unit 22 about the central axis 23 so that the drug solution 24 in the drug container 21 can be separated from the gas space 30 in the inside of the drug container 21 and can rotate along the inner side surface 21*a* of the drug container 21. For example, under the control of the control unit 41, the rotation speed of the drug container 21 is accelerated or decelerated within a range of the set speed from 500 rpm or more to 3000 rpm or less, which can give such centrifugal force as allowing the drug solution 24 to go along the inner side surface 21*a* of the drug container 21. For example, the set speed is set at 1000 rpm. In FIG. 12, as an example, the rotation speed in step S44 is set so as to reach the set speed, for example, by gradually increasing the number of revolutions.

Subsequently, the rotationally vibrating step S300 is a step performed under the control of the control unit 41. In the rotationally vibrating step S300, while maintaining the rotation at the set speed by the rotation mechanism unit 25, the drug container 21 is vibrated in the direction along the central axis 23 of the drug container 21, by the vibration mechanism unit 26, such a rotation operation and such reciprocal vibration are combined with each other, and the second drug and the solution are stirred. In the following, a description is made as mentioned above on the premise that the second drug and the solution are collectively referred to the drug solution 24.

Subsequently, the third rotation step S46 is a step performed under the control of the control unit 41. In the third rotation step S46, the drive of the drug container 21 by the vibration mechanism unit 26 is stopped (corresponding to step S16 of FIG. 5), and thereafter, in a similar way to the first rotation step S44, the container support unit 22 is rotated about the central axis 23 so that the drug solution 24 in the drug container 21 can rotate along the inner side surface 21*a* of the drug container 21. A rotation speed in the third rotation step S46 is set, for example, so as to gradually reduce the number of revolutions from the set speed to the stop of the rotation. After this third rotation step S46 is performed for a predetermined time, the drive of the rotation mechanism unit 25 is stopped (corresponding to step S17 of FIG. 5) under the control of the control unit 41.

Subsequently, in a container taking-out step S47, the drug container 21 is taken out from the container support unit 22 in which the vibration and the rotation are stopped.

Subsequently, in a dissolved state confirming step S48, it is confirmed whether or not the stirring is performed sufficiently.

As described above, before the second step S300 as the stirring operation, the drug container 21 is rotated at two-stage speeds, thereby the penetrating operation for allowing the solution to penetrate the lump of the second drug such as the frozen desiccant is performed, the lump of the second drug is made likely to be broken by the stirring operation, and in such a way, it is made possible to stir and mix the second drug more reliably without foaming the drug solution 24. This is a feature of the third embodiment. As a result, also in the case where the lump of the second drug such as the frozen desiccant is present, it is made possible to rapidly dissolve and stir the lump of the second drug without causing the foaming therein.

In order to confirm effectiveness of the third embodiment, comparison was made among the case of conventional manual preparation in which the pharmacist manually performs the stirring and the cases of performing the stirring under Conditions 1 and 2 by using the stirring apparatus 20A of the third embodiment. Results of the comparison are shown in FIG. 13. Each of the results shown in FIG. 13 is a time in each step, which was required until the second drug was completely dissolved into the solution.

In FIG. 13, in the manual preparation, it was necessary to manually stir the drug container 21 for 180 seconds after the drug container 21 was left at rest for 300 seconds, and it took 480 seconds in total. As a result of performing the manual preparation for 480 seconds, there was no foaming or no undissolved residue.

Moreover, in such automatic preparation under Condition 1 using the stirring apparatus 20A, it was necessary to perform stirring of the drug container 21 for 60 seconds by the stirring apparatus 20A after the drug container 21 was left at rest for 300 seconds, and it took 360 seconds in total. As a result of performing the stirring operation for 360 seconds under Condition 1, there was no foaming or no undissolved residue.

Furthermore, in such automatic preparation under Condition 2 using the stirring apparatus 20A, it was necessary to perform stirring of the drug container 21 for 90 seconds by the stirring apparatus 20A after the drug container 21 was left at rest for 180 seconds, and it took 270 seconds in total. As a result of performing the stirring operation for 270 seconds under Condition 2, there was no foaming or no undissolved residue. Note that, in the automatic preparation under Condition 2, in order to shorten such a stationarily leaving time, during a period of 90 seconds in the stirring time, the first rotation step S43 was performed at 100 rpm for 30 seconds, and the second rotation step S44 and the third rotation step S46 were performed at 500 rpm for 60 seconds.

In accordance with the results in FIG. 13, it was found out that, in the case of automatically performing the stirring under Condition 1 by using the stirring apparatus 20A of the third embodiment, it was possible to shorten such a total time of the preparation (stationarily leaving and stirring operation) to three fourths (75%) of that in the case of the manual preparation. Moreover, it was found that, in the case of automatically performing the stirring under Condition 2 by using the stirring apparatus 20A of the third embodiment, it was possible to shorten the total time of the preparation (stationarily leaving and stirring operation) to nine sixteenths (approximately 56%) of that in the case of the manual preparation. From these results, by using the stirring apparatus 20A of the third embodiment, it was possible to shorten an overall time (total time) of the stationarily leaving and the stirring operation more than in the case of the manual preparation.

Note that, in the first to third embodiments, even if the drug container 21 rotates about an axis shifted a little from the central axis 23 at the time when the drug container 21 is rotated about the central axis 23, such a shift can also be allowed as long as the stirring work can be performed sufficiently.

Moreover, in the first to third embodiments, the number of revolutions of each of the preliminary rotation and the set speed or the vibration width or the cycle in the vibration operation differs depending on a shape or size of the drug container 21, an amount or viscosity of the drug, or the like.

As an example of the vibration operation in the third step S300, the width of the vibration can be set at 10 mm or more to 100 mm or less, and the cycle of the vibration can be set at 1 Hz or more to 10 Hz or less. This is because an effect of the vibration is small when the width of the vibration is less than 10 mm, and the entire device is increased in size when the width of the vibration exceeds 100 mm. Moreover, this is because the effect of the vibration is small when the cycle of the vibration is less than 1 Hz, and it becomes difficult to design the device when the cycle exceeds 10 Hz.

Moreover, as an example of accelerating/decelerating the rotation speed of the drug container 21 in step S23, acceleration after the elapse of a predetermined time and deceleration after the elapse of a predetermined time are repeated. As a specific example, acceleration at 1200 rpm to 2000 rpm after the elapse of one second and deceleration to 900 rpm after the elapse of another one second are repeated.

Note that arbitrary embodiment(s) or modification example(s) among the variety of embodiments or modification examples described above are appropriately combined with one another, thereby effects individually inherent therein can be exerted.

INDUSTRIAL APPLICABILITY

The stirring method and stirring apparatus of the present invention do not require the mechanism for removing bubbles, are suitable for stirring and mixing the drug prone to foam or hard to dissolve, and are useful for the case of stirring the drug in a medical institution such as a hospital.

The entire disclosure of Japanese Patent Application No. 2012-148240 filed on Jul. 2, 2012, including specification, claims, drawings, and summary are incorporated herein by reference in its entirety.

Although the present invention has been fully described in connection with the embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A stirring method comprising:

rotating a drug container about a central axis thereof to move a drug solution in the drug container along an inner side surface of the drug container and to separate the drug solution from a gas space to collect the gas space to a center portion of the drug container; and thereafter reciprocally vibrating the drug container along the central axis in a state where the drug container is rotated, to stir the drug solution.

2. The stirring method according to claim 1, wherein the drug container is arranged in a horizontal state where the central axis thereof extends along a horizontal direction.

3. The stirring method according to claim 1, wherein a rotation speed of the drug container is accelerated or decelerated in an event of moving the drug solution along the inner side surface of the drug container by rotating the drug container.

4. The stirring method according to claim 3, wherein the rotation speed is accelerated or decelerated within a range of 900 rpm or more to 3000 rpm or less.

5. The stirring method according to claim 1, wherein a vibration width of the reciprocal vibration is 10 mm or more to 100 mm or less, and a vibration cycle of the reciprocal vibration is 1 Hz or more to 10 Hz or less.

6. The stirring method according to claim 1, wherein the drug container is arranged and rotated in a horizontal state where a central axis extends along a horizontal direction, so that the drug solution in the drug container is moved along the inner side surface of the drug container, and therebefore, an attitude of the drug container is in a vertically inverted state and is changed to the horizontal state while rotating the drug container at a predetermined rotation speed, so that the central axis of the drug container is set in the horizontal state.

7. The stirring method according to claim 6, further comprising stopping the reciprocal vibration of the drug container after the reciprocal vibration;

wherein, after the reciprocal vibration of the drug container is stopped, the attitude of the drug container is changed from the horizontal state to a vertically inverted state where the drug container is rotated, and thereafter, the rotation of the drug container is stopped.

* * * * *